US007429958B2

(12) United States Patent
Lindackers et al.

(10) Patent No.: US 7,429,958 B2
(45) Date of Patent: Sep. 30, 2008

(54) VEHICLE-MOUNT ANTENNA ASSEMBLIES HAVING SNAP-ON OUTER COSMETIC COVERS WITH COMPLIANT LATCHING MECHANISMS FOR ACHIEVING ZERO-GAP

(75) Inventors: Ralf Lindackers, Waterford, MI (US); Hasan Yasin, Holly, MI (US); Christopher J. Jared, Davison, MI (US); Philip J. Kekel, Saginaw, MI (US); Derek M. Herbert, Auburn Hills, MI (US)

(73) Assignee: Laird Technologies, Inc., Chesterfield, MO (US)

( * ) Notice: Subject to any disclaimer, the term of this patent is extended or adjusted under 35 U.S.C. 154(b) by 73 days.

(21) Appl. No.: 11/605,146

(22) Filed: Nov. 28, 2006

(65) Prior Publication Data

US 2008/0122708 A1 May 29, 2008

(51) Int. Cl.
*H01Q 1/32* (2006.01)

(52) U.S. Cl. ..... 343/713; 343/715; 343/872

(58) Field of Classification Search ..... 343/713, 343/715, 872, 878
See application file for complete search history.

(56) References Cited

U.S. PATENT DOCUMENTS

| | | | | |
|---|---|---|---|---|
| 4,090,030 | A | 5/1978 | Lagasse | |
| H526 | H | 9/1988 | Miller | |
| 5,402,135 | A | 3/1995 | De Marre et al. | |
| 5,515,064 | A | 5/1996 | Bacnik et al. | |
| 5,585,809 | A * | 12/1996 | Yajima et al. | 343/713 |
| 5,757,327 | A | 5/1998 | Yajima et al. | |
| 5,900,840 | A * | 5/1999 | Yajima | 343/713 |
| 6,023,245 | A * | 2/2000 | Gomez et al. | 343/725 |
| 6,168,855 | B1 | 1/2001 | Cohen et al. | |
| 6,377,219 | B2 | 4/2002 | Smith | |
| D461,796 | S | 8/2002 | Boyer | |
| D465,480 | S | 11/2002 | Boyer | |
| 6,486,837 | B2 | 11/2002 | Spiegel et al. | |
| 6,486,841 | B1 | 11/2002 | Imahigashi | |
| 6,492,960 | B2 | 12/2002 | Sullivan | |
| 6,674,412 | B1 | 1/2004 | Schmidt et al. | |
| 6,714,171 | B2 | 3/2004 | Haussler et al. | |
| 6,762,727 | B2 * | 7/2004 | Rochford et al. | 343/713 |

(Continued)

FOREIGN PATENT DOCUMENTS

DE 10 2005 044 611.6 9/2005

(Continued)

*Primary Examiner*—Tan Ho
(74) *Attorney, Agent, or Firm*—Harness, Dickey & Pierce, P.L.C.

(57) ABSTRACT

An antenna assembly generally includes an antenna module mountable to a vehicle body wall. The antenna base module includes a base, a protective cover coupled to the base, at least one antenna element disposed within an interior enclosure collectively defined by the protective cover and the base, and one or more latching members. An outer cosmetic cover has one or more snap clip members engageable with the one or more latching members when the outer cosmetic cover is positioned generally over the protective cover. The snap clip members and latching members are resiliently flexible and configured for forming a resiliently compliant connection therebetween. In a final installed position of the antenna assembly to the vehicle body wall, the lower edge of the outer cosmetic cover conforms against the vehicle body wall substantially without any gap therebetween.

23 Claims, 15 Drawing Sheets

U.S. PATENT DOCUMENTS

| | | | | |
|---|---|---|---|---|
| 6,879,294 | B2 | 4/2005 | Yuanzhu | |
| 6,879,301 | B2 * | 4/2005 | Kozlovski | 343/878 |
| 6,930,643 | B2 | 8/2005 | Byrne et al. | |
| 6,999,033 | B2 | 2/2006 | Kordass et al. | |
| 7,002,523 | B2 | 2/2006 | Noro | |
| 7,004,666 | B2 | 2/2006 | Kozlovski | |
| 7,046,207 | B2 | 5/2006 | Takahashi | |
| 7,088,297 | B2 | 8/2006 | Nakano et al. | |
| 7,106,272 | B2 | 9/2006 | Noro et al. | |
| 7,212,168 | B2 * | 5/2007 | Kozlovski | 343/713 |
| 2002/0145567 | A1 | 10/2002 | Spiegel et al. | |
| 2003/0197649 | A1 | 10/2003 | Kozlovski | |
| 2003/0231136 | A1 | 12/2003 | Du | |
| 2004/0150572 | A1 | 8/2004 | Ohno et al. | |
| 2004/0174311 | A1 | 9/2004 | Kordass et al. | |
| 2004/0217472 | A1 | 11/2004 | Aisenbrey et al. | |
| 2005/0225489 | A1 * | 10/2005 | Aizawa et al. | 343/713 |
| 2005/0237248 | A1 | 10/2005 | Nakano et al. | |
| 2006/0012533 | A1 | 1/2006 | Noro | |
| 2006/0077110 | A1 | 4/2006 | Blickle | |
| 2006/0097937 | A1 | 5/2006 | Gorai et al. | |
| 2006/0110214 | A1 | 5/2006 | Kozlovski | |
| 2006/0244667 | A1 * | 11/2006 | Thompson et al. | 343/713 |
| 2007/0085361 | A1 | 4/2007 | Hauser | |
| 2007/0103374 | A1 | 5/2007 | Lindackers et al. | |
| 2007/0171138 | A1 | 7/2007 | Noro | |

FOREIGN PATENT DOCUMENTS

| | | |
|---|---|---|
| EP | 1411585 | 4/2004 |
| EP | 0862239 | 2/2005 |
| JP | 2005-20660 | 1/2005 |

* cited by examiner

I: Insertion:

$$x_i = L(\sin\theta - \sin\theta_i)$$

$$x_i = a$$

$$\theta_i = \sin^{-1}(\sin\theta - a/L)$$

$$y_i = L(\cos\theta_i - \cos\theta)$$

I: Retention:

$$y_r = \text{overlap} - y_i$$

$$y_r = L(\cos\theta - \cos\theta_r)$$

Fig. 9

VEHICLE-MOUNT ANTENNA ASSEMBLIES HAVING SNAP-ON OUTER COSMETIC COVERS WITH COMPLIANT LATCHING MECHANISMS FOR ACHIEVING ZERO-GAP

FIELD

The present disclosure generally relates to antenna assemblies mountable to mobile platforms, such as automobile or vehicle roofs, hoods, or trunk lids.

BACKGROUND

The statements in this section merely provide background information related to the present disclosure and may not constitute prior art.

Various antenna types are used in the automotive industry, including aerial AM/FM antennas, patch antennas, etc. Antennas for automotive use are commonly positioned on the vehicle's roof, hood, or trunk lid to help ensure that the antenna has an unobstructed view overhead or towards the zenith.

By way of example, antenna assemblies typically include a protective cover for sealing and encasing the electrical components on a printed circuit board. The printed circuit board, in turn, is commonly fixed with screws to a die cast chassis or body of the antenna assembly. The body and cover are then installed, for example, to the vehicle roof. A rubber seal may be used to fill the gap or space between the protective cover and the vehicle roof.

At the assembly plant in which antenna assemblies are installed to the vehicles, it is common for the different styles and colors of the protective covers to be kept together in one place in order to install those covers at the same station. To achieve a zero-gap "look" between the antenna's cover and the roof of the vehicle, a unique antenna cover has to be designed to fit each specific vehicle roof curvature. As recognized by the inventors hereof, this results in logistical issues as well as issues with installation of the correct antenna to intended vehicle.

SUMMARY

According to various aspects, exemplary embodiments are provided of antenna assemblies for installation to vehicles, cosmetic covers for antenna assemblies, and methods related to antenna assemblies. In one exemplary embodiment, an antenna assembly is configured for installation to a vehicle body wall. The antenna assembly generally includes an antenna module mountable to a vehicle body wall. The antenna base module includes a base, a protective cover coupled to the base, at least one antenna element disposed within an interior enclosure collectively defined by the protective cover and the base, and one or more latching members. An outer cosmetic cover has one or more snap clip members engageable with the one or more latching members when the outer cosmetic cover is positioned generally over the protective cover. The snap clip members and latching members are resiliently flexible and configured for forming a resiliently compliant connection therebetween. Accordingly, the snap clip members and latching members, when engaged, are movable in response to the abutment of and pressure applied by the lower edge of the outer cosmetic cover against the vehicle body wall. In the final installed position of the antenna assembly to the vehicle body wall, the lower edge of the outer cosmetic cover conforms against the vehicle body wall substantially without any gap therebetween.

In a further embodiment, an antenna assembly generally includes an antenna base module mountable to a vehicle body wall. The antenna base module includes at least one latching member. An antenna cover has a lower edge and at least one snap clip member engageable with the latching member when the cover is positioned generally over the antenna base module to connect the antenna cover to the antenna base module. The snap clip member and latching member are resiliently flexible and configured for forming a resiliently compliant connection therebetween such that the snap clip member and latching member, when engaged, are movable in response to the abutment of and pressure applied by the lower edge of the antenna cover against the vehicle body wall when the antenna assembly is being secured to the vehicle body wall. In a final installed position of the antenna assembly to the vehicle body wall, the lower edge of the antenna cover conforms against the vehicle body wall with substantially zero-gap therebetween.

Other aspects relate to methods of mounting antenna assemblies to vehicles. In some exemplary embodiments, a method generally includes connecting a first antenna cover to a first antenna base module by moving at least one snap clip member of the first antenna cover into connection with at least one latching member of the first antenna base module so that the at least one snap clip member moves past the at least one latching member. The method may also include conjointly moving the at least one snap clip member and the at least one latching member such that, in a final installed position, a lower edge of the first antenna cover conforms against the first vehicle body wall substantially without any gap therebetween.

Further aspects and features of the present disclosure will become apparent from the detailed description provided hereinafter. In addition, any one or more aspects of the present disclosure may be implemented individually or in any combination with any one or more of the other aspects of the present disclosure. It should be understood that the detailed description and specific examples, while indicating exemplary embodiments of the present disclosure, are intended for purposes of illustration only and are not intended to limit the scope of the present disclosure.

DRAWINGS

The drawings described herein are for illustration purposes only and are not intended to limit the scope of the present disclosure in any way.

FIG. 9 identifies calculations associated with design of snap clip members and latching members viewed in conjunction with FIGS. 7 and 8.

DETAILED DESCRIPTION

Figure 1A:
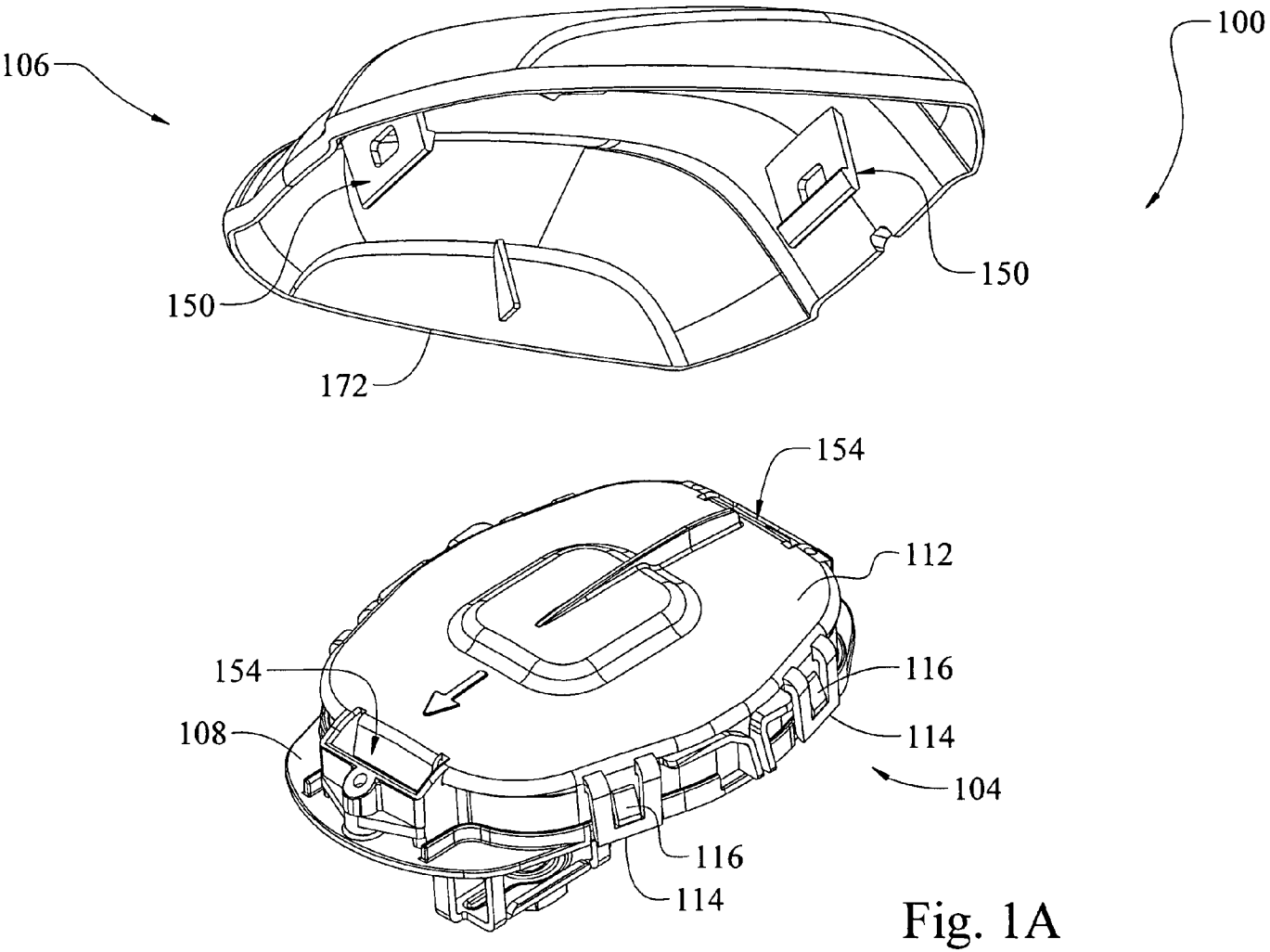
FIGS. 1A and 1B are respective upper and lower exploded perspective views of an antenna assembly having an antenna base module and a snap-on cosmetic cover with compliant latching mechanisms for achieving zero-gap, according to exemplary embodiments.

The following description is merely exemplary in nature and is in no way intended to limit the present disclosure, application, or uses. It should be understood that throughout the drawings, corresponding reference numerals indicate like or corresponding parts and features.

Various embodiments provide styled or cosmetic covers designed to be snapped or latched onto an inner environmental or protective cover (or other component of the antenna base module) before or after the antenna base module is installed or nipped to a vehicle. In some embodiments, substantially zero-gap is achieved between the cosmetic cover and a vehicle body wall (e.g., roof, trunk lid, hood, etc.) through over-travel and back tension snap mechanism, as disclosed herein.

Aspects of the present disclosure relate to antenna assemblies having outer cosmetic covers that may be engaged to antenna assemblies (e.g., antenna base or chassis, protective cover, other component of the antenna assembly, etc.) by way of compliant latching mechanisms. In various embodiments, the compliant latching allows the outer cosmetic cover to float or adjustably move away from or toward an antenna base module (e.g., protective cover, etc.) and the vehicle body wall in order to achieve substantially zero-gap with little to no space between the outer cosmetic cover and the vehicle body wall. In many cases, antenna components are not precisely manufactured due to tolerances and variances. Even so, embodiments disclosed herein provide outer cosmetic covers having to shift or adjust upwardly, for example, to accommodate for the tolerances and still achieve substantially zero-gap with a relatively perfect fit.

In some embodiments, the antenna assembly is configured such that relatively little force is needed for the outer cosmetic cover to move upwardly. But to help ensure that the outer cosmetic cover does not adjust upwardly too far, the antenna assembly includes stops configured for contacting snap clip members of the cosmetic cover after the antenna assembly has been secured to the vehicle wall in a final installed position. This inhibits movement of the outer cosmetic cover away from the stops and limits any further flexing of the latching members and gapping between the vehicle body wall and the lower edge of outer cosmetic cover while under external loads.

In various embodiments, an antenna assembly generally includes a fully functional, environmentally sealed antenna base module and an outer cover that is styled for cosmetic purposes. When the antenna assembly is installed into a mounting opening or cutout of a vehicle body wall, the cover conforms to the vehicle body wall surrounding the opening with substantially zero-gap therebetween. This zero-gap is accomplished by way of a complaint or resilient latching/snapping mechanism and the custom-designed cover for each roof curvature. In these embodiments, the antenna base module is designed so as to fit on different roof curvatures. The interface between the antenna base module and the outer cosmetic cover allows for assembling different covers (with differed styles, colors, curvatures, etc.) to one common antenna base module. Advantageously, this may allow multiple antenna styles and colors that may be fitted to one common base module, which, in turn, should help reduce installation errors and logistical issues in the assembly plants.

Accordingly, aspects of the present disclosure may allow for use of a common antenna base module across a wide range of automobiles despite the different roof curvatures and contours of the automobiles. With the compliant latching mechanisms disclosed herein, the outer cosmetic cover is capable of floating or moving relative to the antenna base module, to thereby ensure a relatively perfect fit or interfacing with variously contoured vehicle roofs. By allowing for the use of a single antenna base module design across different vehicle types, aspects of the present disclosure allow for common parts and tooling, which may, in turn, allow for reduced costs.

Figure 1B:
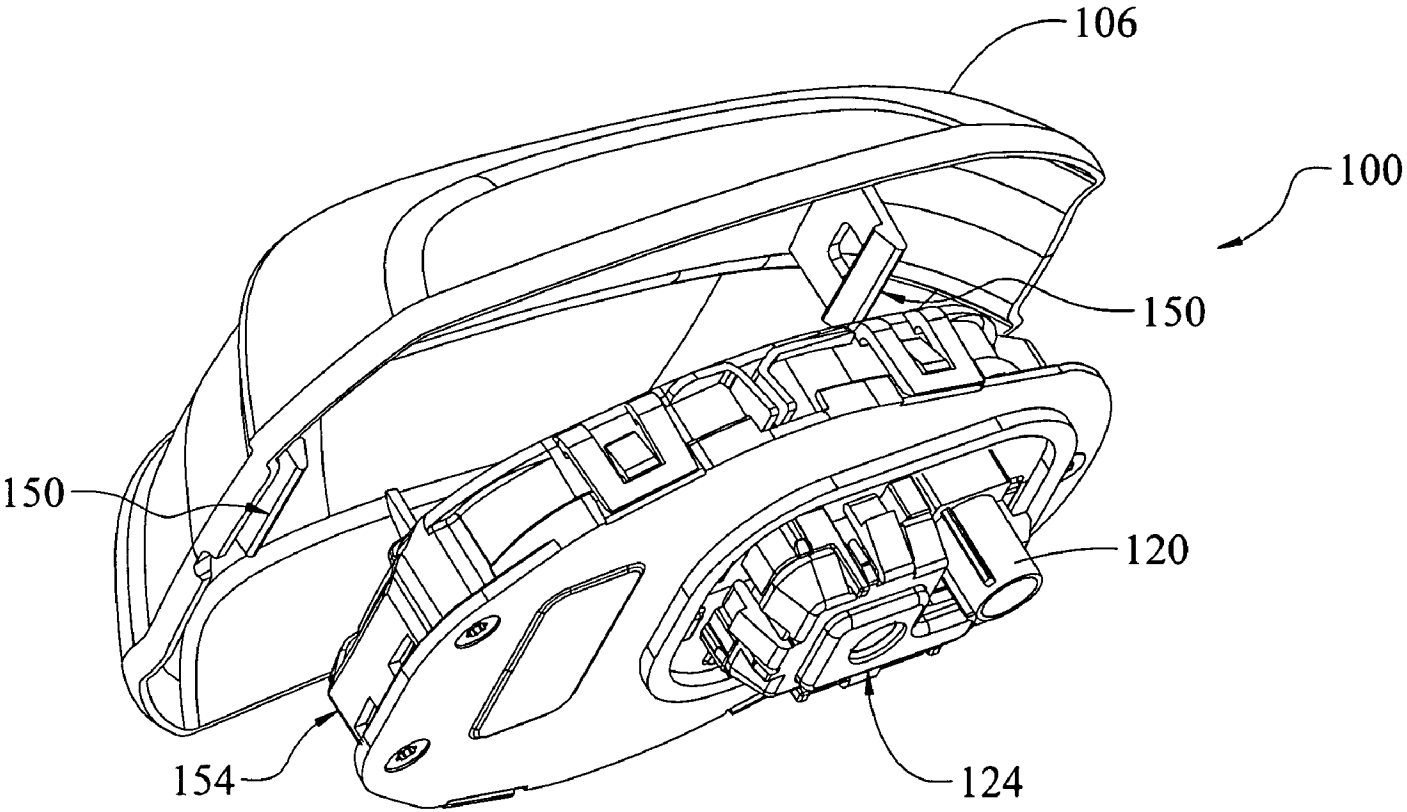

With reference to FIGS. 1A and 1B, there is shown an exemplary antenna assembly 100 embodying one or more aspects of the present disclosure. As shown, the antenna assembly 100 includes a fully-functional, environmentally sealed antenna base module 104 that is mountable to a vehicle body wall, such as a vehicle roof, trunk lid or hood (not shown). An outer, concave-shaped, snap-on cosmetic cover 106 is securable to the antenna base module 104 for encasing the base module 104 and providing an aesthetically pleasing appearance to the antenna assembly 100 with a substantially zero-gap fit with the vehicle body wall.

The antenna base module 104 includes a base or chassis 108, a protective environmental cover (or radome) 112 attached (e.g., latched, snap-clipped, etc.) to the base 108. The antenna base module 104 also includes at least one antenna element (not shown) disposed within the interior enclosure collectively defined by the protective cover 112 and the base 108. The protective cover 112 may be seated on the antenna base 108 as illustrated. Alternatively, other embodiments may include a protective cover that overlaps the base 108 and substantially encases the base 108.

In the illustrated embodiments, the interior enclosure is substantially sealed by the protective cover 112. This sealing preferably inhibits the ingress of contaminants (e.g., dust, moisture, etc.) into the interior enclosure in which at least one antenna element may be disposed. The protective cover 112 may be formed from a wide range of materials, such as polymers, urethanes, plastic materials (e.g., polycarbonate blends, Polycarbonate-Acrylnitril-Butadien-Styrol-Copolymer (PC/ABS) blend, etc.), glass-reinforced plastic materials, synthetic resin materials, thermoplastic materials (e.g., GE Plastics Geloy® XP4034 Resin, etc.), among other suitable materials.

In some embodiments, the antenna base 108 may be die cast from zinc. Alternatively, the antenna base 108 may instead be formed by a different process other than die casting, and/or be formed from a different material or composite of materials.

It should be understood that some embodiments of the antenna assembly may include only an outer cover without an inner protective environmental cover. In these alternative embodiments, the outer cover may not only provide an aesthetically pleasing appearance to the antenna assembly with a substantially zero-gap fit with the vehicle body wall, but the outer cover may also function as a protective cover. For example, the outer cover may thus be configured to secure to the antenna base and help with sealing of the interior enclosure of the antenna base module to inhibit the ingress of contaminants into the interior enclosure in which at least one antenna element may be disposed. By way of further example, some of these alternative embodiments may include at least one sealing member that is disposed between the outer cover and the vehicle body wall for sealing the interface therebetween. This sealing member may comprise a discrete component separate from the outer cover, or it may be integral to the outer cover.

In those embodiments that include both an inner protective cover and an outer cosmetic cover (examples of which are shown in the figures); the inner protective cover may be attached to the antenna base module in various ways. A description will be provided of one exemplary method by which a protective cover may be attached to the antenna base module hereinafter. This description, however, is provided for purposes of illustration only and not for limitation.

Figure 2:
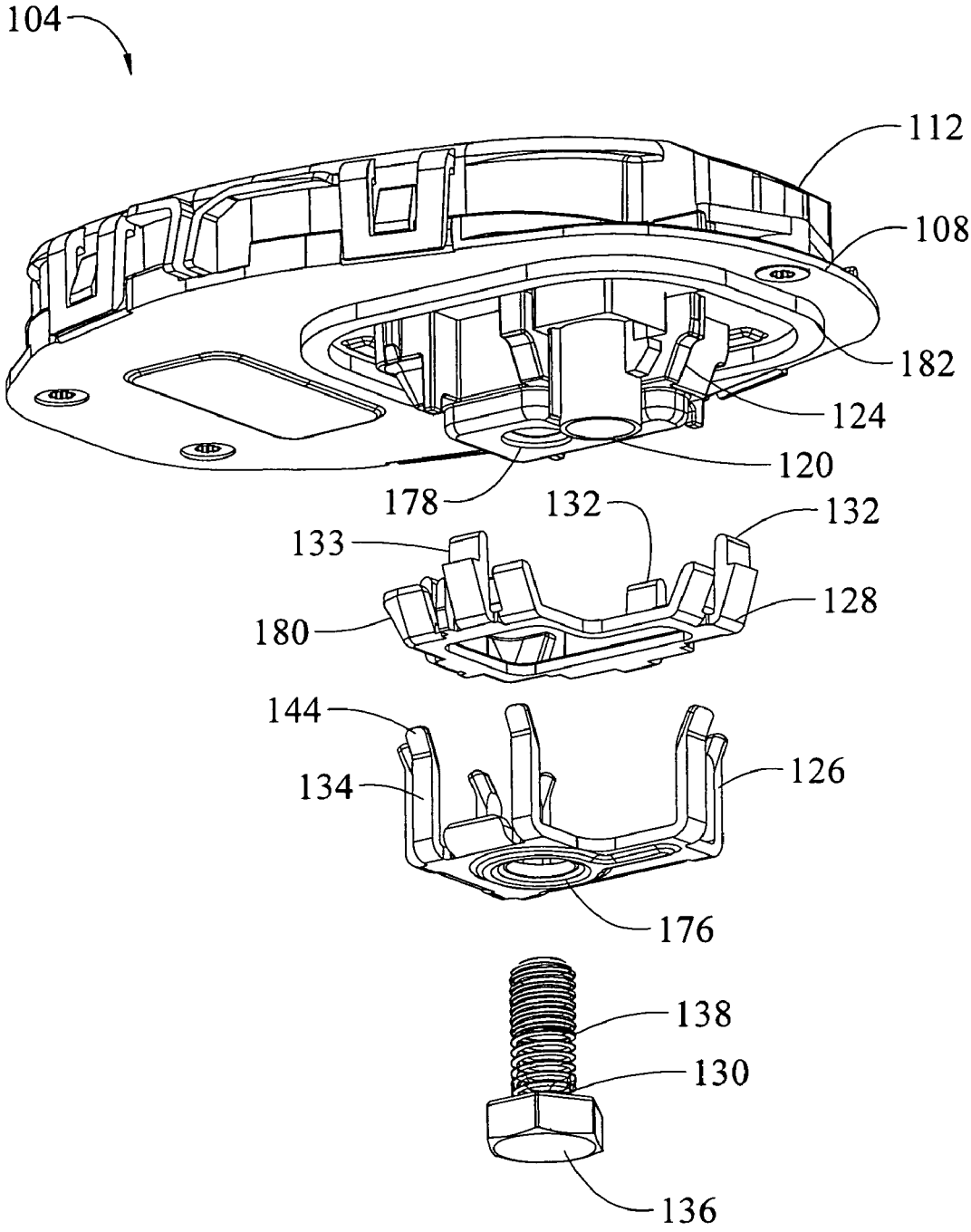
FIG. 2 is an exploded perspective view of an antenna base module of one exemplary embodiment.

With reference to FIGS. 1A and 2, the protective cover 112 has snap-tabs 114 for engagement with corresponding beveled snap-tab receiving portions 116 associated with the antenna base 108 to help secure the protective cover 112 to the base 108. The snap-tab receiving portions 116 are integrally located about a perimeter of the antenna base 108. The snap-tab receiving portions 116 are designed to engage the flexible snap-tabs 114 of the protective cover 112 to fasten and matingly secure the protective cover 112 to the base 108. Essentially, as the protective cover 112 is positioned over the base 108, the snap-tabs 114 momentarily flex outwardly and then return back inwardly in the reverse direction after they have cleared the snap-tab receiving portions 116. In the illustrated embodiment, the protective cover 112 includes a pair of snap-tabs 114 on each longitudinal side of the protective cover 112. The base 108 includes two corresponding snap-tab receiving portions 116 on longitudinal sides of the base 108. Alternatively, more or less snap-tabs 114 and receiving portions 116 and/or different arrangements of the same may be used in other embodiments. For example, the protective cover 112 may also or alternatively have snap-tabs 114 at about the front and back longitudinal ends of the protective cover. In addition, the arrangement of the snap-tabs 114 and snap-tab receiving portions 116 may be reversed. In which case, the base 108 may include snap-tabs 114 with the protective cover 112 including the snap-tab receiving portions 116. Also shown in FIGS. 4C, mechanical fasteners, such as screws 118, among other fastening devices, etc., may also be used for securing the protective cover 112 to the base 108. Alternative embodiments may include other means for attaching a protective cover to a base, such as by ultrasonic welding, interference or snap fit, solvent welding, heat staking, latching, bayonet connections, hook connections, integrated fastening features, mechanical fasteners, combinations thereof, etc.

In some embodiments, a sealing member (e.g., O-ring, resiliently compressible elastomeric or foam gasket, etc., but not shown) may be provided for substantially sealing the protective cover 112 and base 108. Still further embodiments may not include a separate protective cover. For example, one exemplary embodiment of the antenna assembly 100 generally includes a single cover which is attached to the antenna base 108 by a compliant latching mechanism that facilitates a substantially zero-gap fit with a vehicle body wall. This particular embodiment may also include at least one sealing member between the cover and the vehicle body wall for sealing the interface therebetween.

As best shown in FIG. 2, an electrical connector 120 extends outward from an underside of the antenna base 108 for coupling the antenna assembly 100 to a suitable communication link (not shown). In some embodiments, the electrical connector 120 may be an ISO (International Standards Organization) standard electrical connector or a Fakra connector attached to the antenna base 108. Accordingly, a coaxial cable (or other suitable communication link) may be relatively easily connected to the electrical connector 120 and used for communicating signals received by the antenna assembly 100 to another device, such as a radio receiver, display screen, or other suitable device. In such embodiments, the use of standard ISO electrical connectors or Fakra connectors may allow for reduced costs as compared to those antenna installations that require a customized design and tooling for the electrical connection between the antenna assembly 100 and cable. In addition, the pluggable electrical connections between the communication link and the antenna assembly's electrical connector 120 may be accomplished by the installer without the installer having to complexly route wiring or cabling through the vehicle body wall. Accordingly, the pluggable electrical connection may be easily accomplished without requiring any particular technical and/or skilled operations on the part of the installer. Alternative embodiments, however, may include using other types of electrical connectors and communication links (e.g., pig tail connections, etc.) besides standard ISO electrical connectors, Fakra connectors, and coaxial cables.

With continued reference to FIG. 2, the base module 104 also includes a mounting structure 124 that extends outward from the underside of the antenna base 108. First and second retaining components 126 and 128 and fastener member 130 are adjacent the mounting structure 124 and serve to interconnect with the mounting structure 124 to facilitate securing the antenna base module 104 to a vehicle body wall. In the illustrated embodiment, the first retaining component 126 includes four positioning clips 132 each having shoulders 133 for supporting the interconnected assembly 100 on a vehicle body wall. The second retaining component 128 includes seven retaining legs 134 configured to fit over the first retaining component 126 and mounting structure 124. Each retaining leg 134 extends generally outward and upward from the retaining component 128 and terminates at an end portion 144, which is shaped to engage a vehicle body wall and hold the antenna assembly 100 in place. The fastener member 130 (which is illustrated as an exemplary threaded bolt having a hexagonal head 136 and threaded portion 138) serves to secure the first and second retaining components 126 and 128 to the mounting structure 124 of the base 108. This interconnection will be described in more detail hereinafter for purposes of illustration only.

Figure 3:
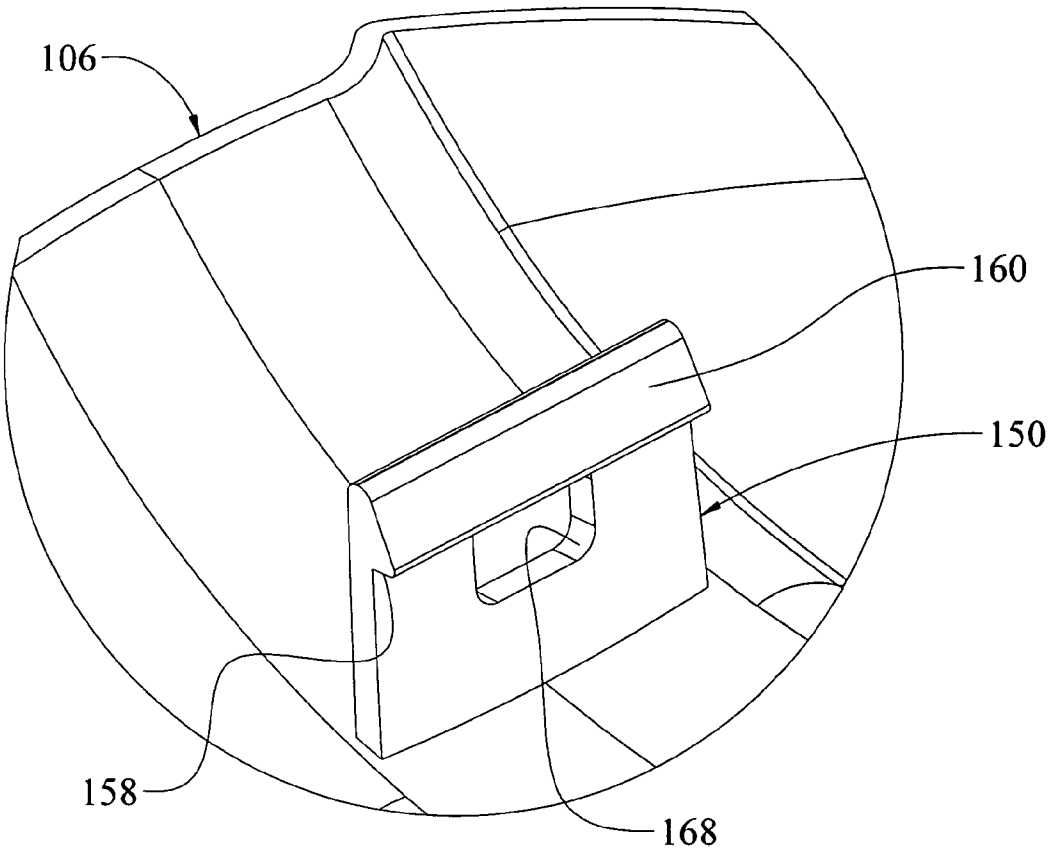
FIG. 3 is a perspective view of one of the snap clip members of the cosmetic cover shown in FIG. 1.

With reference now to FIGS. 1A and 3, the cosmetic cover 106 includes two snap clip member 150 located toward the longitudinal ends of the cover 106. Each snap clip member 150 extends generally downward form inside the cover 106. The snap clip members 150 are preferably resiliently flexible. Each snap clip members 150 also preferably includes an upper abutment surface 158 and a lower cam surface 160. The resilient, or compliant, nature of the snap clip members 150 allows them to resiliently bend, flex, deform, or otherwise move relative to the cosmetic cover 106, as described in more detail hereinafter.

In the illustrated embodiment, the snap clip members 150 are formed integral with the cosmetic cover 106. In other embodiments, the snap clip members 150 may be formed separate from the cover. In which case, the snap clip members would be separately attached to the cover, for example, by welding, adhesives, etc.

Figure 4A:
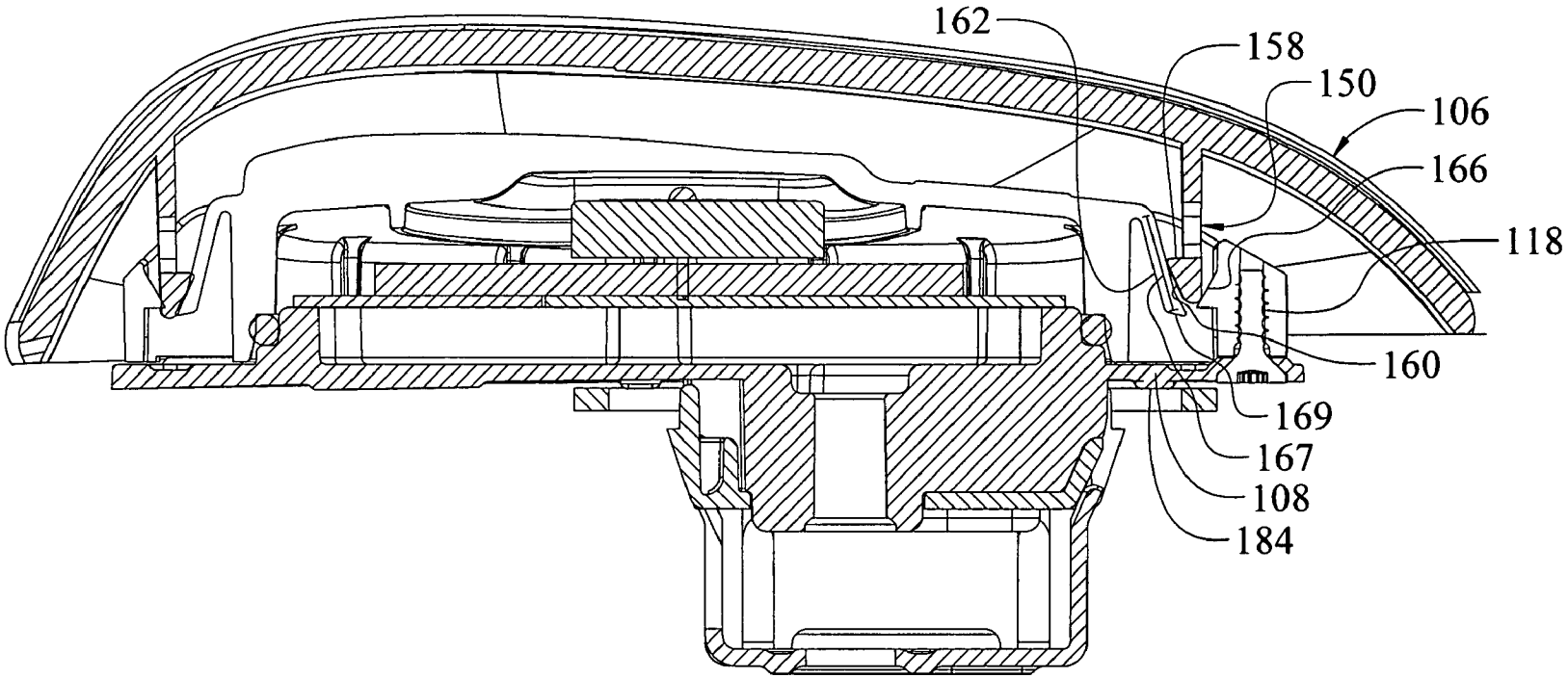
FIGS. 4A through 4C are longitudinal cross-sectional views of the antenna assembly shown in FIG. 1 and illustrating various stages of an exemplary installation process for connecting the cosmetic cover to the antenna base module of the antenna assembly.
Figure 4B:
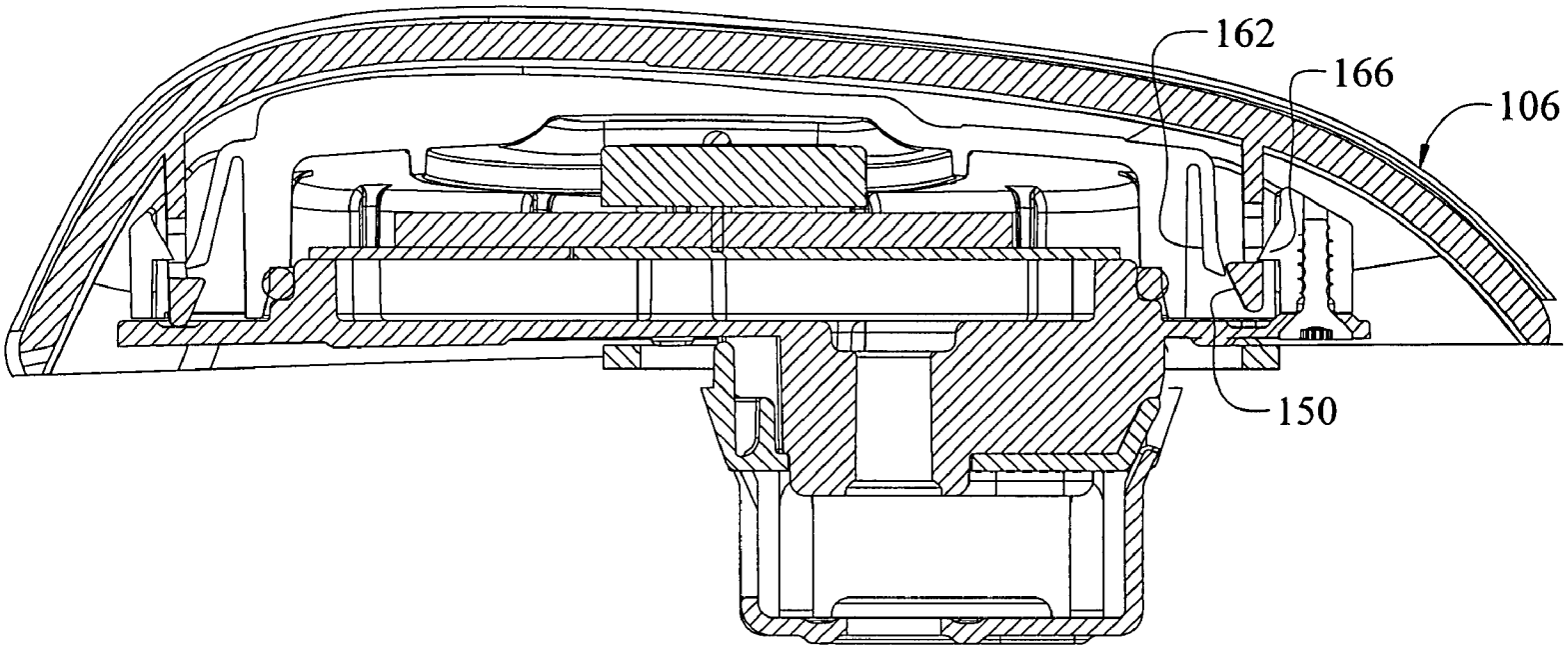
Figure 4C:
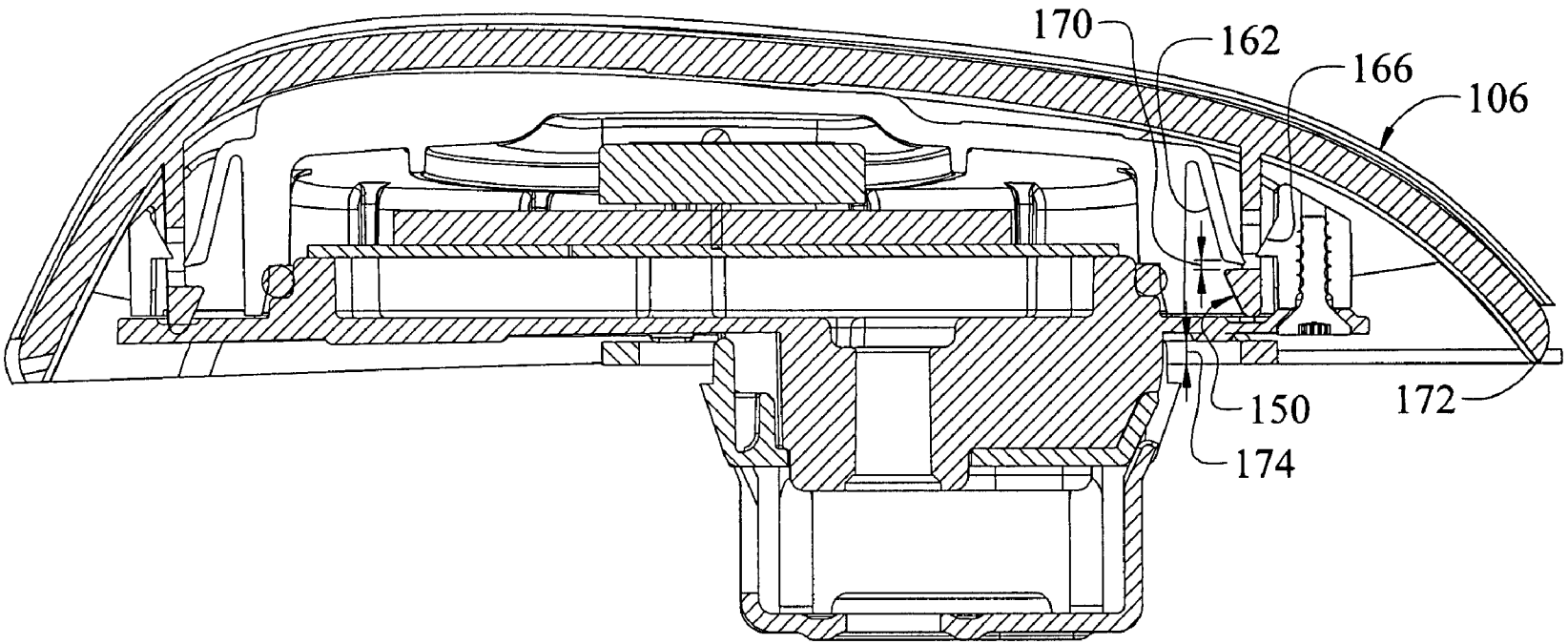

As shown in FIG. 1A, the protective cover 112 includes two latches or latching mechanisms 154 that are configured for engagingly receiving the snap clip members 150 for forming a resiliently compliant connection of the cosmetic cover 106 to the base module 104. As shown in FIGS. 4A through 4C, the latches 154 each include a latching member 162 and a generally opposing stop 166. Each latching member 162 has a length 167 and is resiliently flexible for allowing it to resiliently bend, flex, deform, or otherwise move relative to the protective cover 112 either away from or toward the stop 166, as described in more detail later in reference to FIG. 7. The stops 166 may be configured to be operable for limiting vertical motion of the cosmetic cover 106 away from the protective cover 112. By limiting or inhibiting the amount of vertical motion, the stops 166 may be operable to provide at least some level of overstress protection to the latching members 162.

In the illustrated embodiment, the latching members 162 and stops 166 are formed integral with the protective cover 112. In other embodiments, the latching members 162 and stops 166 may each be formed separate from the protective cover 112. In such alternative embodiments, the latching members 162 and stops 166 may be separately attached to the protective cover, for example, by welding, adhesives, etc. Other embodiments of the antenna assembly 100 may have covers 112 that include only one snap clip member 150 and one only latch 154. Still other embodiments may include an antenna assembly having three or more snap clip members and latches.

In still other embodiments, the latching members 162 and/or stops 166 may be formed integral with or be attached to another antenna component, such as the antenna base, etc. For example, in those embodiments that include only an outer cover 106 without the inner protective cover 112, latches 154 may be integrally formed in or attached to the base 108 or other structural components of the antenna base module 104.

With reference now to FIGS. 4A through 6, an exemplary process will be described for initially connecting the outer cosmetic cover 106 to the antenna base module 104 (an initial connected position), and then connecting the interconnected cosmetic cover 106 and antenna base module 104 to a roof R of a vehicle (a final connected, or installed position). In other exemplary processes, the antenna base module 104 may first be connected to the vehicle roof R (or other vehicle body wall), and then the cosmetic cover 106 may be connected to the base module 104 in the final connected position.

As shown in FIGS. 4A through 4C, the cosmetic cover 106 is positioned generally over the protective cover 112 so that the snap clip members 150 align with the latches 154. The cosmetic cover 106 is then pressed onto the protective cover 112 so that each snap clip member 150 moves into its corresponding latch 154. For convenience only, operation of only one snap clip member 150 and latch 154 will be further described with it being understood that operation of the other snap clip member and latch will be substantially the same. As the snap clip member 150 moves into the latch 154, the snap clip member 150 engages the latching member 162 and opposing stop 166 (FIG. 4A). As the snap clip member 150 contacts the stop 166, the stop 166 will initially urge the snap clip member 150 to move slightly away from the stop 166. In one particular embodiment, the snap clip member 150 bends slightly (e.g., about five millimeters, etc.) to clear the stop 166. With continued insertion of the snap clip member 150, the cam surface 160 of the snap clip member 150 contacts the latching member 162. This contact urges the latching member 162 away from the stop 166, which, in turn, provides space or room between the latching member 162 and stop 166 for the snap clip member 150 to move past (FIGS. 4B and 4C). As seen by comparing FIGS. 4B and 4C, the snap clip member 152 (after clearing the tip of the latching member 162) will snap or move back to its original, un-flexed position. As shown in FIG. 4C, the stop 166 is positioned in a cutout portion 168 of the snap clip member 150, and the resilient latching member 162 moves back to its original, un-flexed position with a latching surface 169 thereof generally aligned with and above the snap clip's abutment surface 158. At this point, the cosmetic cover 106 is retained over the protective cover 112 and antenna base module 104, and removal of the cosmetic cover 106 from off the protective cover 112 will be resisted by the latching member's latching surface 169 engaging the snap clip's abutment surface 158.

With continued reference to FIG. 4C, the snap clip member 150 is preferably sized lengthwise to move a sufficient distance past the latching member 162 and stop 166 when the cosmetic cover 106 is being initially provided on and connected to the base module 104. This provides a space or room for the latching member 162 to return to its original, un-flexed position without interference from the snap clip member 150 after initially bending away from the stop 166. This "over travel" distance 170 of the snap clip member 150 is generally a measure of the maximum distance (for the illustrated embodiment) between the latching member's latching surface 169 and the snap clip's abutment surface 158 when the cosmetic cover 106 is initially provided onto and connected to the base module 104 (but before the assembly 100 is finally connected to a vehicle body wall). As shown in the progressive views of FIGS. 4A through 4C, when the snap clip member 150 bends the latching member 162 away from the stop 166, the snap clip member 150 moves the latching member 162 a rotational direction. This rotational movement causes the latching member 162 to move both downward and inward (i.e., to the left as viewed in the drawings). In turn, this requires that the snap clip's abutment surface 158 to move sufficiently under the latching member's latching surface 169 in order for the lathing member 162 to return to its original, unflexed position. Accordingly, the over travel 170 provides room for the latching member 162 to rotate away from the stop 166 and allow the abutment surface 158 of the snap clip member 150 to pass under its latching surface 169, and then to return to its original, un-flexed position generally over the snap clip's abutment surface 158. The over travel 170 also allows the snap clip member 150 (and thus the cosmetic cover 106) to move relative to the latching member 162 and base 108 when in the initial connected position. In the illustrated embodiment, the over travel 170 is about 0.5 millimeters. In other embodiments, the over travel 170 may be about 0.4 millimeters or more. In still further embodiments, the over travel 170 may range from greater than 0 millimeters to about 2 millimeters. The over-travel distance may depend, for example, on the particular geometry of the latch member 162. Plus, the dimensions provided in this paragraph (as are all dimensions disclosed herein) are for purposes of illustration only and not for purposes of limitation.

With further reference to FIG. 4C, the cosmetic cover 106 is shown initially connected to the antenna base module 104. In this position, the antenna base 108 is substantially within the cosmetic cover 106 so that a lower edge 172 of the cosmetic cover 106 is generally below (as viewed in FIG. 4C) a lower surface of the base 108. This overlap is indicated at 174, and is a measure of the maximum separation between the lower surface of the base 108 (or the top face of the roof of the figure in FIG. 4C) and the lower edge 172 of the cosmetic cover 106. It should be apparent from FIG. 4C that the overlap separation 174 is maximum when the over travel 170 is maximum. Plus, the overlap 174 is also greater than the over travel 170. In the illustrated embodiment, the overlap separation 174 is preferably about 0.9 millimeters. In other embodiments the overlap separation 174 may be about 0.7 millimeters or more. The overlap may be calculated by adding the over travel 170 with tension (e.g., typical tension may be about 0.3 millimeters, etc.). The dimensions provided in this paragraph (as are all dimensions disclosed herein) are for purposes of illustration only and not for purposes of limitation.

With initial connection of the cosmetic cover 106 to the antenna base module 104 now described, a description of the final connection/installation of the antenna assembly 100 to a vehicle will now be provided according to exemplary embodiments. The antenna assembly 100 (including the cosmetic cover 106) is positioned within a mounting opening in a vehicle roof R. The installation process may also include drawing the cosmetic cover 106 and antenna base module 104 into tight contact with the vehicle roof R so that the lower edge 172 of the cosmetic cover abuts and applies pressure against roof R with substantially no gaps between the cosmetic cover 106 edge and roof, thereby providing a substantially zero-gap fit.

Before positioning the antenna assembly 100 within the mounting opening, the bolt 130 is positioned through an opening 176 in the second retaining component 128 and threadingly engaged to a correspondingly threaded portion 178 associated with the mounting structure 124 of the antenna base 108. By way of example, the threaded portion 178 may comprise a threaded insert or threaded member that is separately attached or coupled to the antenna base 108. Or, for example, the threaded portion 178 may be integrally defined or formed by the antenna base 108. When the bolt 130 is thus threaded, it captures the second retaining component 128 and first retaining component 126 against the mounting structure 124. The legs 134 of the second retaining component align with cam surfaces 180 of the first retaining component 126, and the ends 144 of the legs generally face the antenna base 108. This facilitates positioning the antenna assembly 100 in the mounting opening in the vehicle roof R since the first and second retaining components 126 and 128 and bolt 130 will not fall or drop out as the antenna assembly 100 is being positioned in the opening and connected to the roof. Capturing the components in this exemplary manner also allows the installer (from outside the vehicle) to easily position the antenna assembly 100 as a single unit (including the cosmetic cover 106 and antenna base module 104) relative to the vehicle mounting opening. Advantageously, this allows for a reduction in the number of operations or steps needed for antenna 100 installation as compared to those installation methods in which there is no such capturing of the fastener and retaining components.

Next, the antenna assembly 100 is positioned (from outside the vehicle) as a single unit into the mounting opening in the vehicle roof R. As the antenna assembly 100 is moved downwardly relative to the roof opening, the resilient positioning clips 132 of the first retaining component 126 will be deformed or distorted inward temporarily to fit through the mounting opening, but will expand outwardly upon passing through the opening completely due to their resiliency or elasticity. The cam surfaces 180 of the first retaining component 126 and the legs 134 of the second retaining component 128 are configured (e.g., dimensionally sized, shaped, etc.) such that they will not catch the inside of the roof mounting opening as they are inserted through the opening. The particular configurations for the retaining legs 134 and cam surfaces 180 may depend, for example, on the particular location at which the antenna assembly 100 is to be used, space considerations, etc. In addition, each retaining leg 134 does not necessarily have the same configuration (e.g., size, shape, etc.) in other embodiments. Alternative embodiment may include more or less than seven retaining legs 134, and/or retaining legs having different configurations (e.g., shapes, dimensions, etc.) than what is show in the figures. For example, other embodiments include retaining legs 134 with L-shaped or U-shaped feet or end portions.

Figure 5A:
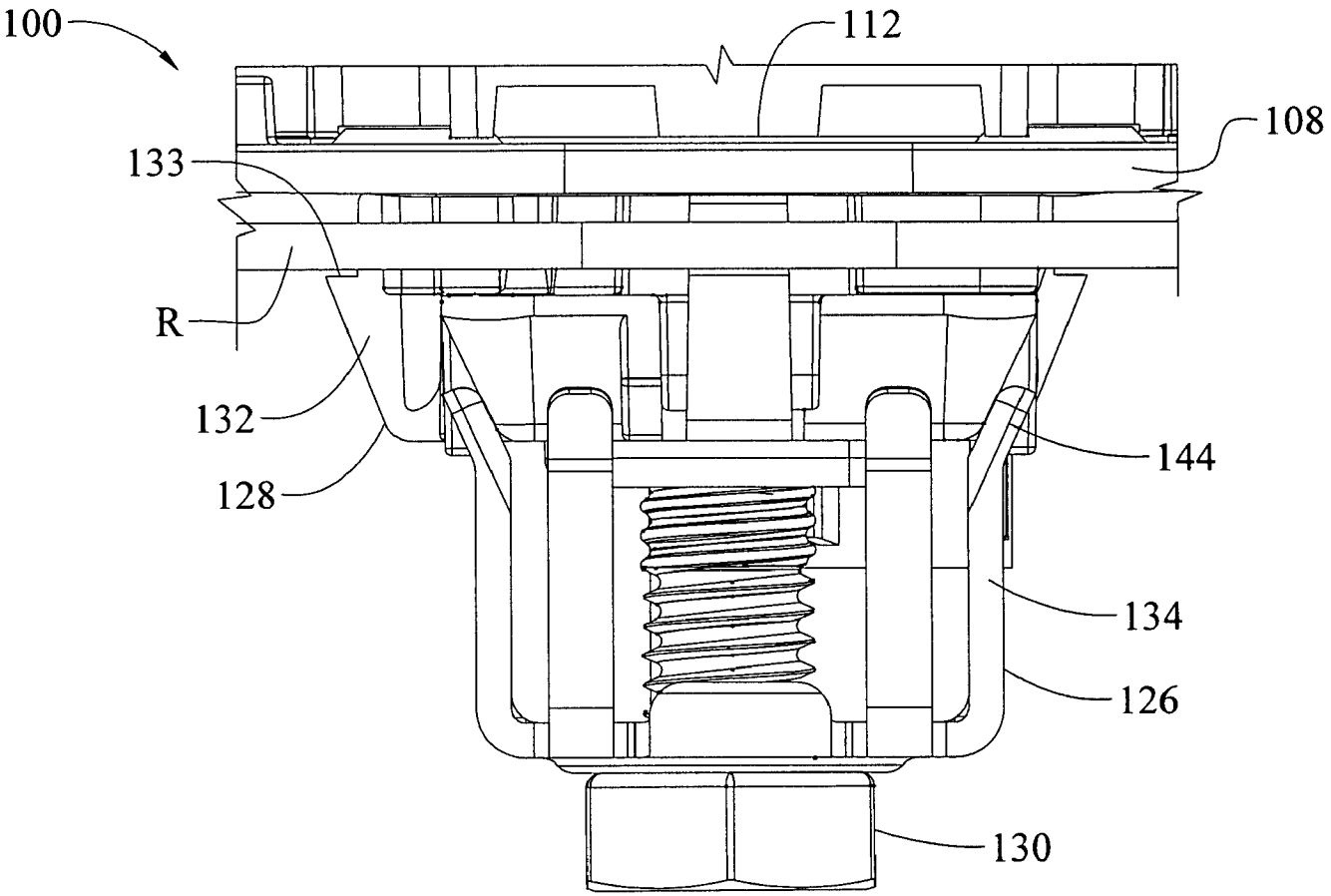
FIGS. 5A through 5D are enlarged fragmentary side views of the antenna assembly shown in FIG. 1 with the cosmetic cover removed and illustrating various stages of securing the assembly to a vehicle body wall.

In this stage of the installation process shown in FIG. 5A, the antenna assembly 100 is temporarily held in place by virtue of the interaction of the shoulder portions 133 of the clips 132, vehicle roof R, and antenna base 108. The shoulder portions 133 of the clips 132 are disposed under the interior surface of the vehicle roof R, while the antenna base 108 is disposed on the exterior side of the vehicle roof R. Also in this stage of the installation process, the lower edge 172 of the cosmetic cover 106 abuts the roof R, and the latching member's latching surface 169 loosely rests on the snap clip's abutment surface 158 suspending the antenna base 108 generally above the exterior surface of the vehicle roof R. It should be apparent that the base 108 is suspended above the exterior surface of the vehicle roof R an amount equal to the over travel 170 subtracted from the overlap 174. In the illustrated embodiment, the antenna base 108 is suspended about 0.4 millimeters above the vehicle roof R. In other embodiments, the antenna base 108 may be suspended about 0.3 millimeters or more above the vehicle roof R. The dimensions provided in this paragraph (as are all dimensions disclosed herein) are for purposes of illustration only and not for purposes of limitation.

The installer may now enter the vehicle to access the head 136 of the bolt 130 using a socket wrench (not shown) or other suitable tool to grip the hexagonal head 136 of the bolt 130 to rotate it and tighten it. FIGS. 5A through 5D show progression of this tightening process. As the bolt 130 rotates, it threads into the corresponding threaded portion 178 associated with the antenna base's mounting structure 124. Alternative embodiments may include other suitable driving elements, fasteners, bolts having differently-shaped or non-hexagonal heads, etc. The rotating bolt 130 pulls the second and first retaining components 128 and 126 upward toward the interior surface of the vehicle roof R while at about the same time pulls the antenna base 108 downward toward the exterior surface of the vehicle roof R. The cam surfaces 180 of the first retaining component 126 are configured to deform and expand the retaining legs 134 of the second retaining component 128 generally outward as the bolt 130 pulls the second retaining component upward. Continued movement of the bolt 130 pulls the end portions 144 of the legs 134 into contact with the interior side of the vehicle roof R. This contact may also help facilitate or cause the legs 134 (or at least the outwardly bent end portions 144 thereof) to deform and expand generally outward. This outward deformation and flexing of the retaining legs 134 provides a relatively secure engagement between the ends 144 of the legs and the interior of the roof R. The continued bolt movement also pulls the antenna base 108 downward into contact with the exterior surface of the vehicle roof R. Standoffs 184 of the antenna base 108 engage the roof R and, together with the retaining legs 134, securely hold the antenna assembly 100 against the roof on the vehicle. The overlap 174 between the lower surface of the base 108 and the lower edge 172 of the cosmetic cover 106 is now about zero millimeters.

Figure 5B:
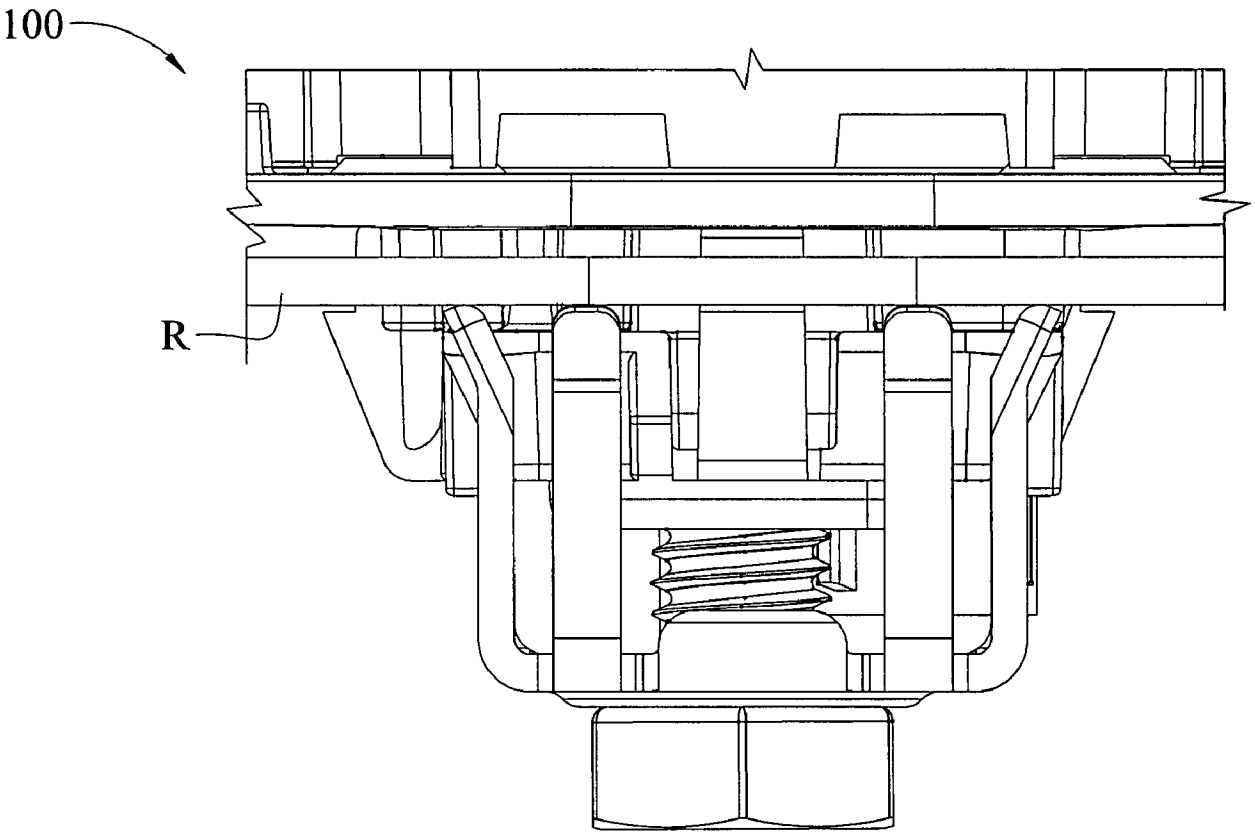
Figure 5C:
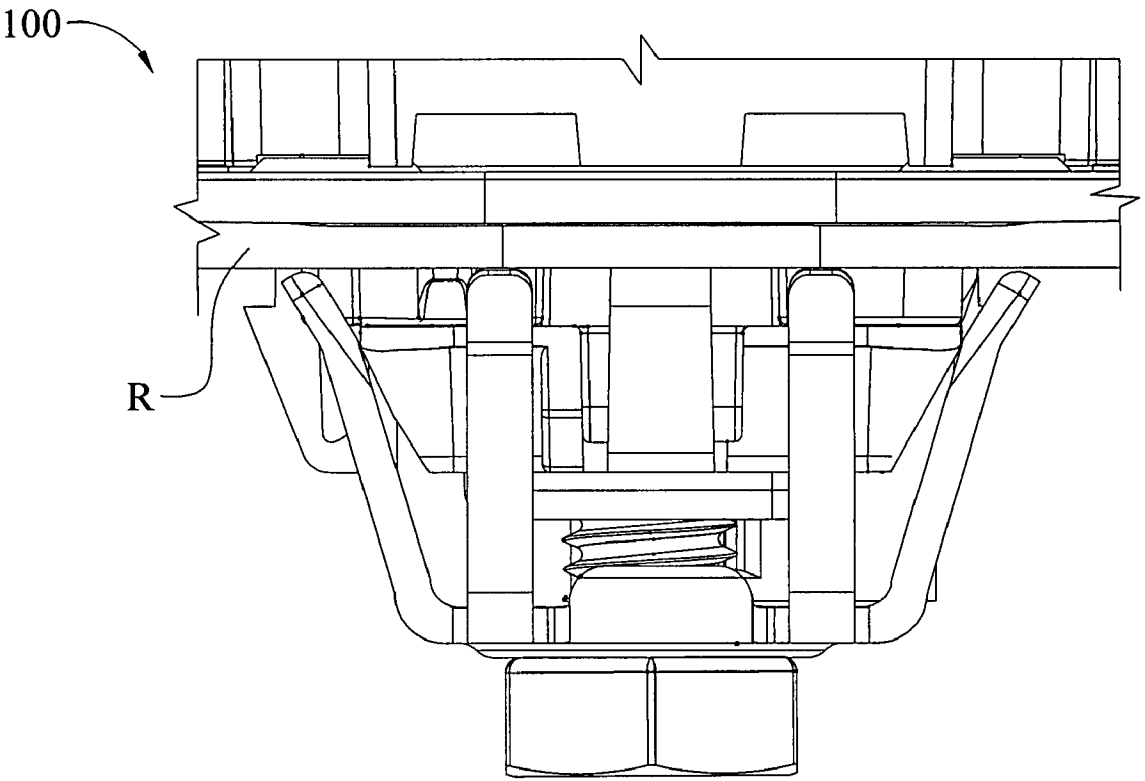
Figure 5D:
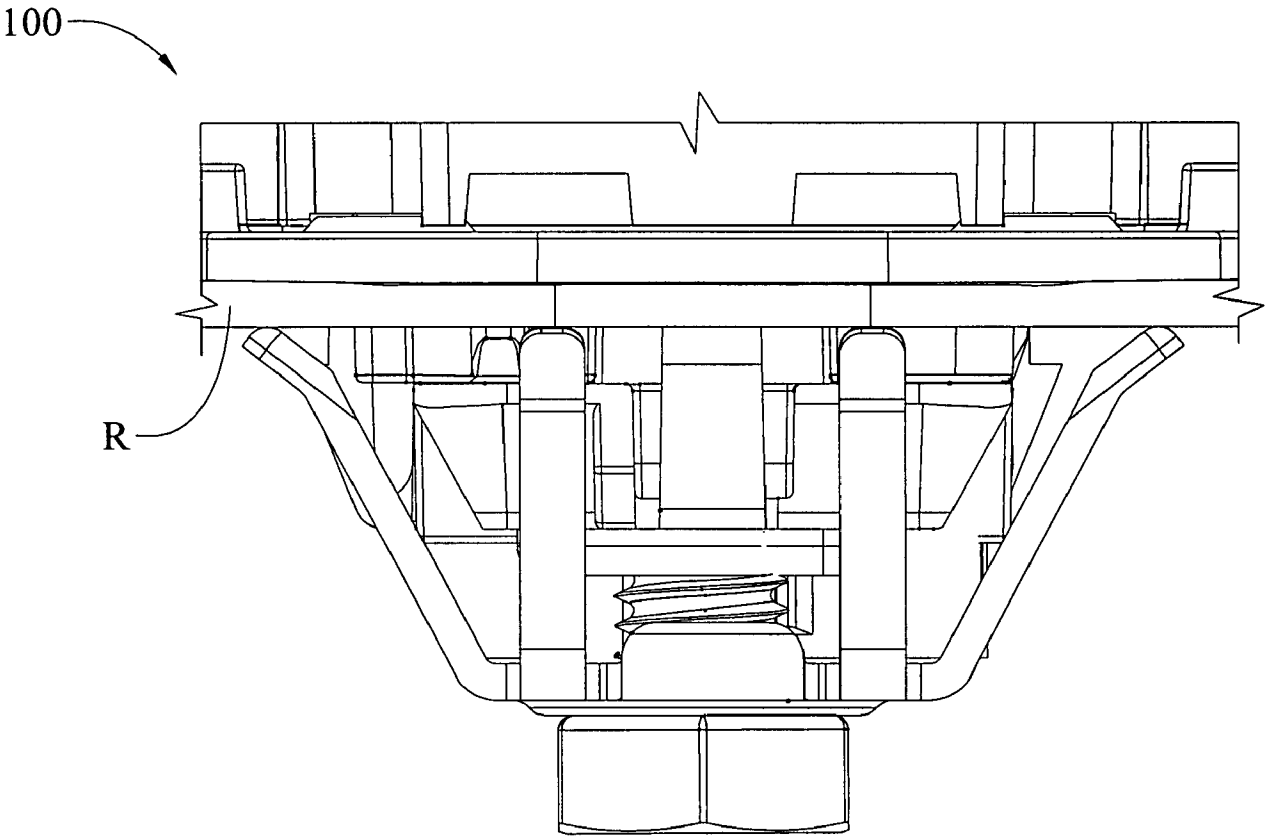

As can be seen in FIGS. 5A and 5B, a seal 182 (e.g., O-ring, resiliently compressible elastomeric or foam gasket, etc.) is provided for substantially sealing the underside of the antenna base 108 and the external side of the vehicle roof R. As also shown in FIG. 2, the seal 182 is generally annular and is seated within a groove generally surrounding the mounting structure 124 and electrical connector 120. Preferably, the seal 182 prevents (or at least inhibits) the ingress or penetration of water, moisture, dust, or other contaminants through the mounting opening into the interior of the vehicle after the antenna assembly 100 is finally installed to the vehicle. In some embodiments, the seal 182 is formed from a sufficiently resilient material (e.g., elastomeric or foam material, etc.) that allows the seal to be compressively seated at least partially within the groove such that the seal 182 will not drop or fall out as the antenna assembly 100 is being mounted to the vehicle roof R. Alternatively, or additionally, sealing may be achieved by one or more sealing features integrally formed or defined by the antenna base 108. As another example, a sealing member may also be provided generally between the antenna base 108 and the protective cover 112. Alternatively, or additionally, sealing may be achieved by one or more sealing features integrally formed or defined by the antenna base 108.

Figure 6:
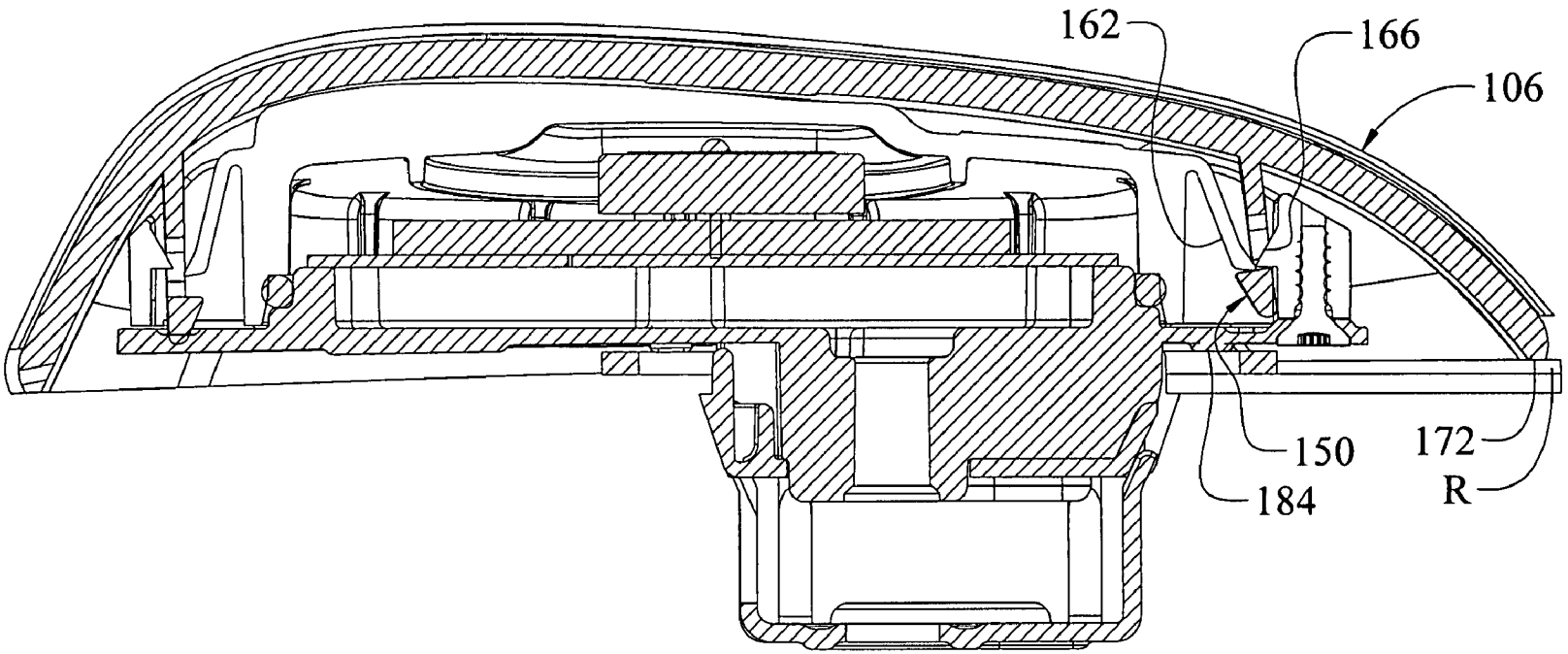
FIG. 6 is a longitudinal cross-sectional view similar to FIGS. 4A through 4C with the cosmetic cover connected to the antenna base module and illustrating a latching member of the antenna base module under tension with substantially zero-gap between the cosmetic cover and a vehicle body wall.

With reference now to FIG. 6, the above described downward movement of the antenna base 108 (and thus downward movement of the protective cover 112 connected to the base 108) relative to the vehicle roof R causes the protective cover's latching member 162 to contact and urge downward the abutment surface 158 of the snap clip member 150. The snap clip member 150, however, is held generally against this movement by the cosmetic cover 106, which is already in engagement with the exterior surface of the vehicle roof R. Therefore, to accommodate the downward movement of the antenna base 108 and protective cover 112, the latching member 162 flex, bends, deforms, or otherwise moves relative to the base module 104 generally outward and upward (as viewed in FIG. 6) toward the stop 166. This creates a back tension in the latching member 162 urging downward on the snap clip member 150, which, in turn, helps hold the cosmetic cover 106 against the exterior surface of the vehicle roof R. The snap clip member 150 similarly bends outward and upward (as viewed in FIG. 6) with the latching member 162 to accommodate the movement of the latching member 162, further creating a back tension in the snap clip member 150 that also helps hold the cosmetic cover 106 against the exterior surface of the vehicle roof R. It can now be appreciated that the back tension in both the snap clip member 150 and latching member 162 helps pull the cosmetic cover 106 into substantially zero-gap contact with the vehicle roof R as the antenna base 108 is drawn downward by the bolt 130 during final connection/installation. The stop 166 adjacent the latching member 162 is positioned to limit the outward movement of the latching member 162 and snap clip member 150 to inhibit over-tensioning and possibly breaking. The stop 166 also acts to inhibit movement of the outer cosmetic cover 106 away from the stop 166, thus limiting any further flexing of the latching member 162 and possible gapping between the vehicle roof R and lower edge 172 of the outer cosmetic cover 106, such as when the cover 106 is exposed to external loads (e.g., aerodynamic forces, wind, etc.). The upward component of the bending movement (the vertical component as viewed in FIG. 6) of the latching member 162 is indicated as $y_r$ at 187 in FIG. 7. In the illustrated embodiment, this distance 187 is about 0.4 millimeters. In some embodiments, the vertical component 187 of the latching member's bending movement may be about 0.3 millimeters or more. In other embodiments, the vertical component 187 may be less than about 0.3 millimeters. The dimensions provided in this paragraph (as are all dimensions disclosed herein) are for purposes of illustration only and not for purposes of limitation.

In the exemplary installation process just described, the cosmetic cover 106 was initially engaged to the antenna base module 104 before nipping (from inside the vehicle) and securely attaching the antenna base module 104 to the vehicle roof R. In that exemplary process, the nipping of the antenna assembly 100 to the vehicle roof R by driving the fastener member 130 also caused the lower edge 172 of the outer cosmetic cover 106 to abut and apply pressure against the vehicle roof R. This installation process is only one of many possible ways for which a cover of the present disclosure may be used and installed to a vehicle. For example, other embodiments include the antenna base module being nipped and securely attached to a vehicle roof R before positioning the outer cosmetic cover over the antenna base module. In this alternative installation process, downward pressure may be applied to the outer cosmetic cover (e.g., by an installer manually pushing downward on the cover, etc.) for causing the snap clip members to contact and urge the latching members out of the way and thereby allow the snap clip members to be moved past the latching members (over travel distance). The downward pressure will also cause the lower edge of the outer cosmetic cover to abut and apply pressure against the vehicle roof R. In response to the cessation of downward pressure applied to the cover, the snap clip members and latches may be resiliently bent, flexed, deformed, or otherwise moved relative to the cosmetic cover for creating the substantially zero-gap fit of the outer cosmetic cover to the vehicle roof R.

It should now be apparent that together the over travel 170 and back tension described with respect to the snap clip members 150 and latching members 162 of the cosmetic cover 106 and protective cover 112, respectively, as well as their resilient (or compliant) nature allow the cosmetic cover 106 to float or adjustably move upward or downward away from or toward the protective cover 112 and vehicle roof R (or other body wall of the vehicle) as necessary to achieve a substantially zero-gap fit such that there is little to no space between the lower edge 172 of the cosmetic cover 106 and the vehicle roof R. For example, even when the antenna components are not precisely manufactured due to tolerances and variances, the ability of the outer cosmetic cover 106 to float or shift or adjust upwardly or downwardly to accommodate for the tolerances will still allow for substantially zero-gap with a relatively perfect fit. Moreover, when antenna base modules 104 are installed on different vehicles having different vehicle body wall shapes such that differently shaped cosmetic covers are intended to be used, the unique floating or adjustable interconnection described herein between the snap clip members 150 of the cosmetic cover 106 and the latching member 162 of the base module 104 (or vice versa) allow for substantially zero-gap fit of these cosmetic covers using a common base module.

In some aspects, the above described exemplary installation process may include repeating the process for additional antenna assemblies. For example, the process may include installing a first antenna assembly 100 to a first vehicle. The first antenna assembly 100 may include a first antenna base module 104 and a first cosmetic cover 106 sized and shaped to conform to the shape of the vehicle wall surface of the first vehicle. The process may then include installing a second antenna assembly to a second vehicle different from the first vehicle. The second antenna assembly may include an antenna base module 104 having the same or common design as the antenna base module 104 of the first antenna assembly 100. But the second antenna assembly may have a different cosmetic cover that is tailored or configured (e.g., sized, shaped, colored, etc.) so as to conform to the different features (e.g., contour, curvature, color, etc.) of the second vehicle wall surface. The process may further include installing additional antenna assemblies having common antenna base modules but different cosmetic covers to additional vehicles, which may have differently shaped, curved, contoured, etc. vehicle wall surfaces.

Figure 7:
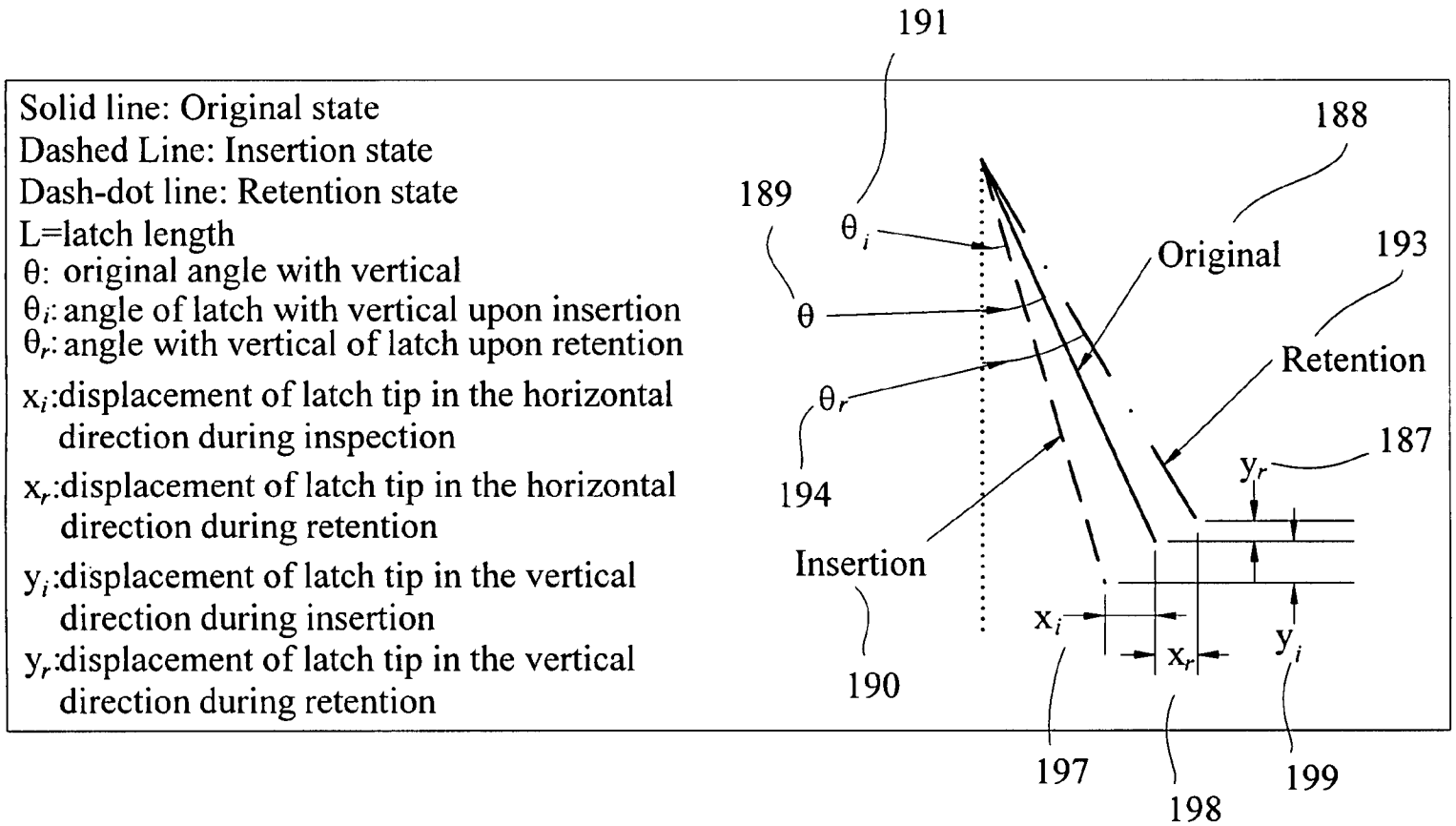
FIG. 7 is a simplified schematic view of the latching member of the antenna base module shown in FIG. 1 and illustrating behavior of the latching member during insertion and retention according to exemplary embodiments.
Figure 8:
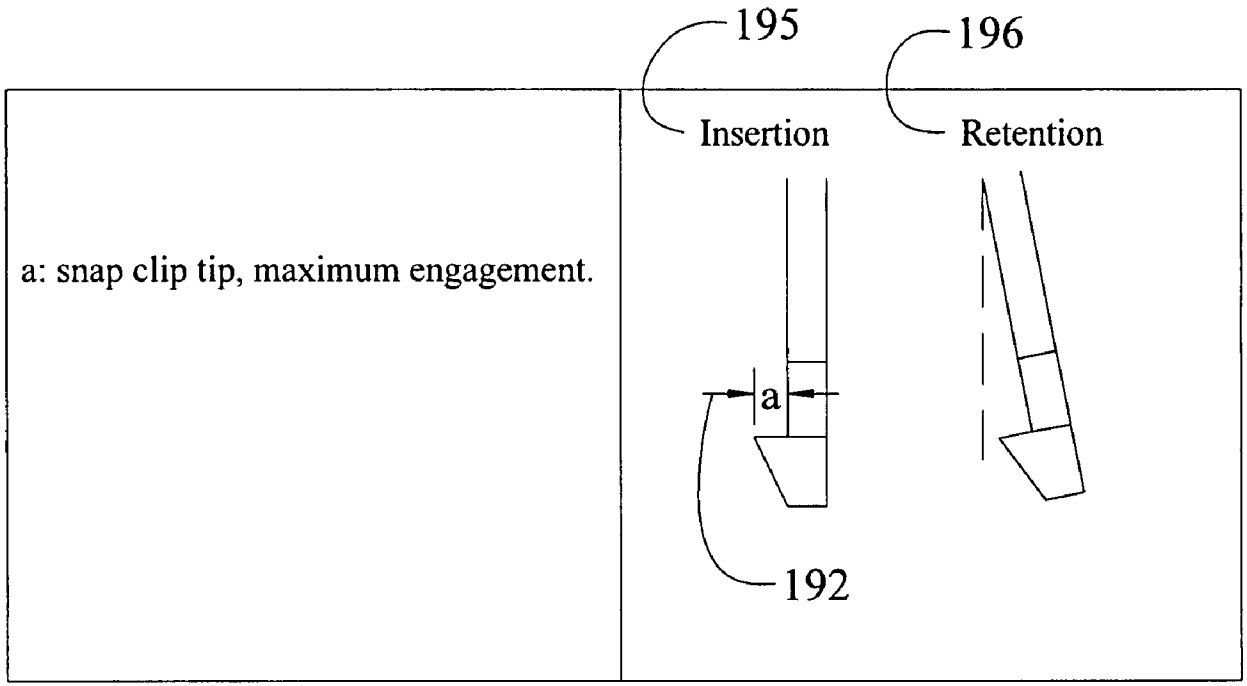
FIG. 8 is a simplified schematic view of a snap clip member of the cosmetic cover shown in FIG. 1 and illustrating behavior of the snap clip member during insertion and retention according to exemplary embodiments.

FIGS. 7 through 9 illustrate design concepts for controlling bending movement of the latching member 162 (see FIG. 7) and snap clip member 150 (see FIG. 8) during installation of the antenna assembly 100. With reference to FIG. 7, when the snap clip member 150 initially moves into the latch 154 and engages the latching member 162 and stop 166, it pushes against and causes rotation of the latching member 162 from its original, un-flexed position 188 at an initial vertical angle 189 to an insertion position 190 at a vertical angle 191. This rotational movement allows the snap clip member 150 to move past the latching member 162. The latching member 162 moves a sufficient horizontal distance 197 (to the left as viewed in the drawings) to clear the width 192 (FIG. 8) of the abutment surface of the snap clip member 150. The latching member 162 also moves a vertical distance 199 during the insertion from its original position.

Now with reference to FIGS. 7 and 8, after the snap clip member 150 is initially connected to the latching member 162 and when the antenna base 108 is nipped or pulled into engagement with the vehicle roof R for final connection, the latching member 162 applies pressure against (essentially pulling downward on) the snap clip member 150. To accommodate the downward movement, both the latching member 162 and snap clip member 150 conjointly rotate outward (counterclockwise rotation toward the right in the drawings). The latching member 162 rotates from its original position 188 to a retention position 193 at a vertical angle 194 (FIG. 7), and the snap clip member 150 rotates from its original position 195 to a retention position 196 (FIG. 8). The extent of the movement of the latching member 162 and snap clip member 150 from their original positions to their retention positions is substantially the same. As shown in FIG. 7, the latching member 162 moves a horizontal distance 198 (to the right as viewed in FIG. 7) from its original position to its retention position.

In one exemplary embodiment, the antenna assembly 100 comprises the antenna base module 104 with the protective cover 112, and the cosmetic cover 106. The latching members 162 of the protective cover 112 have a length 167 of about ten millimeters and are initially oriented at an initial vertical angle 189 of about twenty-five degrees. The snap clip members 150 of the cosmetic cover 106 have an abutment surface length 192 of about 1.2 millimeters, and the designed overlap is about 0.8 millimeters. Using this embodiment, the design concepts of FIGS. 7 through 9 will be further described. When the snap clip member 150 initially moves into the latch 154, it rotates the latching member 162 to an insertion position 190 at a vertical angle 191 of about 17.6 degrees (see FIG. 9). To accommodate this rotation, and for the snap clip member 150 and latching member 162 to operate properly, the over travel 170 must be at least about 0.47 millimeters (see FIG. 9). When the antenna base 108 is then nipped or pulled into engagement with the vehicle roof R for final connection, the latching member 162 moves from its original, un-flexed position 188 to its insertion position 190. The vertical component 187 of this bending movement is about 0.33 millimeters, and the vertical angle 191 of the insertion position 190 is about twenty-nine degrees (see FIG. 9).

In the above-described examples, the snap clip members 150 and latching members 162 were both configured to allow them to resiliently bend, flex, deform, or otherwise move. Alternative embodiments may include the latching members bending, flexing, or deforming but without any bending, flexing, or deforming of the snap clips. In either case, the cosmetic cover may include stops for limiting upward vertical motion of the cover away from the antenna base to help the antenna assembly withstand external forces applied to the latch members. The stops may thus be operable to provide at least some level of overstress protection to the latching members.

By way of example only, it should be understood that some embodiments of the antenna assembly 100 may include a patch antenna positioned on a circuit board secured to the base 108. In addition, some embodiments of the antenna assembly 100 may include a directional element that is positioned on an external surface of the protective cover 112. In some embodiments, a protective layer or shield may protect the directional element from weather and the elements.

It should be understood that embodiments and aspects of the present disclosure may be used in a wide range of antenna applications, such as patch antennas, telematics antennas, antennas configured for receiving satellite signals (e.g., Satellite Digital Audio Radio Services (SDARS), Global Positioning System (GPS), cellular signals, etc.), antennas configured for receiving RF energy or radio transmissions (e.g., AM/FM radio signals, etc.), combinations thereof, among other applications in which wireless signals are communicated between antennas. Accordingly, the scope of the present disclosure should not be limited to only one specific form/type of antenna assembly.

In addition, various antenna assemblies and components disclosed herein can be mounted to a wide range of supporting structures, including stationary platforms and mobile platforms. For example, an antenna assembly disclosed herein could be mounted to supporting structure of a bus, train, aircraft, among other mobile platforms. Accordingly, the specific references to automobiles or vehicles herein should not be construed as limiting the scope of the present disclosure to any specific type of supporting structure or environment.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. An antenna assembly for installation to a vehicle body wall, the antenna assembly comprising:

an antenna base module mountable to the vehicle body wall, the antenna base module including a base, a protective cover coupled to the base, at least one antenna element disposed within an interior enclosure collectively defined by the protective cover and the base, and one or more latching members;

an outer cosmetic cover having one or more snap clip members engageable with the one or more latching members when the outer cosmetic cover is positioned generally over the protective cover;

the snap clip members and latching members being resiliently flexible and configured for forming a resiliently compliant connection therebetween such that the snap clip members and latching members, when engaged, are movable in response to the abutment of and pressure applied by the lower edge of the outer cosmetic cover against the vehicle body wall; and whereby, in the final installed position of the antenna assembly to the vehicle body wall, the lower edge of the outer cosmetic cover conforms against the vehicle body wall substantially without any gap therebetween.

2. The antenna assembly of claim 1, wherein the resiliently compliant connection and flexing movement of the engaged snap clip members and latching members allows relative movement between the outer cosmetic cover and the antenna base module.

3. The antenna assembly of claim 1, wherein the flexing movement of the engaged snap clip members and latching members places the snap clip members under tension thereby helping hold the lower edge of the cosmetic cover against the vehicle body wall substantially without any gap therebetween.

4. The antenna assembly of claim 1, wherein the base includes one or more standoffs configured for contacting the vehicle body wall when the antenna assembly is secured to the vehicle body wall in a final installed position, the contact limiting any further relative movement of the base towards the vehicle body wall.

5. The antenna assembly of claim 1, further comprising one or more stops configured for contacting the snap clip members after the antenna assembly has been secured to the vehicle body wall in a final installed position, to thereby inhibit movement of the outer cosmetic cover away from the one or more stops and gapping between the vehicle body wall and the lower edge of the outer cosmetic cover while under external loads.

6. The antenna assembly of claim 1, wherein the snap clip members and latching members are configured such that:

when the outer cosmetic cover is being positioned generally over the protective cover, the latching members are caused to move in a first direction to thereby allow abutment surface portions of the snap clip members to be positioned generally under corresponding latching surface portions of the latching members; and when the antenna assembly is being secured to the vehicle body wall, the snap clip members and latching members engaged therewith are caused to move in a second direction generally opposite the first direction in response to a force generated by the lower edge of the outer cosmetic cover contacting and applying pressure against the vehicle body wall.

7. The antenna assembly of claim 6, wherein the snap clip members include cam surface portions configured to contact corresponding portions of the latching members for urging the latching members in the first direction when the outer cosmetic cover is being positioned generally over the protective cover.

8. The antenna assembly of claim 6, wherein the snap clip members and latching members are configured to allow over travel of the abutment surface portions beyond the corresponding latching surface portions such that a spaced distance separates the abutment surface portions from the latching surfaces after the abutment surface portions have been positioned generally under the corresponding latching surface portions, but before installing the antenna assembly to the vehicle body wall.

9. The antenna assembly of claim 8, wherein the over travel is about 0.4 millimeters or more.

10. The antenna assembly of claim 1, wherein the latching members are integrally defined by the protective cover, and wherein the snap clip members are integrally defined by the outer cosmetic cover.

11. The antenna assembly of claim 1, wherein the outer cosmetic cover is configured to be externally positioned over the protective cover in only one orientation.

12. An antenna assembly for installation to a vehicle body wall, the antenna assembly comprising:

an antenna base module mountable to the vehicle body wall, the antenna base module including at least one latching member;

an antenna cover having a lower edge and at least one snap clip member engageable with the latching member when the cover is positioned generally over the antenna base module to connect the antenna cover to the antenna base module;

the snap clip member and latching member being resiliently flexible and configured for forming a resiliently compliant connection therebetween such that the snap clip member and latching member, when engaged, are movable in response to the abutment of and pressure applied by the lower edge of the antenna cover against the vehicle body wall when the antenna assembly is being secured to the vehicle body wall;

whereby, in a final installed position of the antenna assembly to the vehicle body wall, the lower edge of the antenna cover conforms against the vehicle body wall with substantially zero-gap therebetween.

13. The antenna assembly of claim 12, wherein the antenna base module comprises a substantially flat base, the antenna cover being configured to receive the base such that a first distance separates the base from the lower edge of the antenna cover after connecting the cover to the antenna base module but before securing the antenna assembly to the vehicle body wall.

14. The antenna assembly of claim 13, wherein the first distance is about 0.7 millimeters or more.

15. The antenna assembly of claim 13, wherein the first distance is about zero millimeters after securing the antenna assembly to the vehicle body wall.

16. The antenna assembly of claim 13, wherein the snap clip member and latching member are configured to allow over travel of the snap clip member beyond the latching member such that a second distance separates the snap clip member from the latching member after connecting the antenna cover to the antenna base module but before securing the antenna assembly to the vehicle body wall.

17. The antenna assembly of claim 16, wherein the first distance is greater than the second distance.

18. The antenna assembly of claim 17, wherein a vertical component of the movement of the engaged snap clip member and latching member, after securing the antenna assembly to the vehicle body wall, is the difference between the first distance and the second distance, the difference being about 0.3 millimeters or more.

19. The antenna assembly of claim 12, wherein the antenna base module comprises two latching members, wherein the antenna cover comprises two snap clip members.

20. The antenna assembly of claim 12, wherein the antenna base module comprises a base, a protective cover coupled to the base, and at least one antenna element disposed within an interior enclosure collectively defined by the protective cover and the base, the antenna cover receiving at least a portion of the protective cover and base therein after connecting the antenna cover to the antenna base module.

21. A method relating to installation of antenna assemblies to vehicle body walls, the method comprising:

connecting a first antenna cover to a first antenna base module by moving at least one snap clip member of the first antenna cover into connection with at least one latching member of the first antenna base module so that the at least one snap clip member moves past the at least one latching member;

conjointly moving the at least one snap clip member and the at least one latching member such that, in a final installed position, a lower edge of the first antenna cover conforms against the first vehicle body wall substantially without any gap therebetween;

connecting a second antenna cover having a different design from the first antenna cover to a second antenna base module having a common design to the first antenna base module; and conjointly moving the at least one snap clip member and the at least one latching member such that, in a final installed position, a lower edge of the second antenna cover conforms against the second vehicle body wall substantially without any gap therebetween.

22. The method of claim 21, wherein conjointly moving the at least one snap clip member and the at least one latching member allows relative movement between the first antenna cover and the first antenna base module.

23. The method of claim 21, wherein conjointly moving the at least one snap clip member and the at least one latching member places the at least one snap clip member under tension for helping hold the lower edge of the first antenna cover against the first vehicle body wall substantially without any gap therebetween.

* * * * *